United States Patent [19]

Rohner

[11] 4,333,201

[45] Jun. 8, 1982

[54] DEVICE FOR PREVENTING THE DISCHARGE OF DUST AND FIBER PARTICLES FROM THE WORK ZONES OF A TEXTILE MACHINE

[75] Inventor: Joachim Rohner, Mönchen-Gladbach, Fed. Rep. of Germany

[73] Assignee: W. Schlafhorst & Co., Mönchen-Gladbach, Fed. Rep. of Germany

[21] Appl. No.: 95,312

[22] Filed: Nov. 19, 1979

[30] Foreign Application Priority Data

Jan. 27, 1979 [DE] Fed. Rep. of Germany ..... 2903139

[51] Int. Cl.[3] ..... A47L 5/38

[52] U.S. Cl. ..... 15/301; 15/346; 57/304

[58] Field of Search ..... 15/301, 345, 346; 57/304

[56] References Cited

U.S. PATENT DOCUMENTS

| | | | |
|---|---|---|---|
| 2,717,484 | 9/1955 | Hofstetter | 15/301 X |
| 2,924,023 | 2/1960 | Datwyler | 57/304 |
| 3,071,918 | 1/1963 | Hofstetter | 57/304 |
| 3,373,552 | 3/1968 | Scherr | 57/304 |
| 4,055,937 | 11/1977 | Latus et al. | 57/304 X |
| 4,107,910 | 8/1978 | Furstenberg | 57/304 X |

*Primary Examiner*—Chris K. Moore
*Attorney, Agent, or Firm*—Herbert L. Lerner

[57] ABSTRACT

Device for preventing the discharge of dust and fiber particles from textile machine work zones having running threads disposed therein, including an air screen system disposed between the work zones and the ambient air in the vicinity of the machine, the air screen system including air discharge nozzles and air suction nozzles.

11 Claims, 5 Drawing Figures

FIG. 2
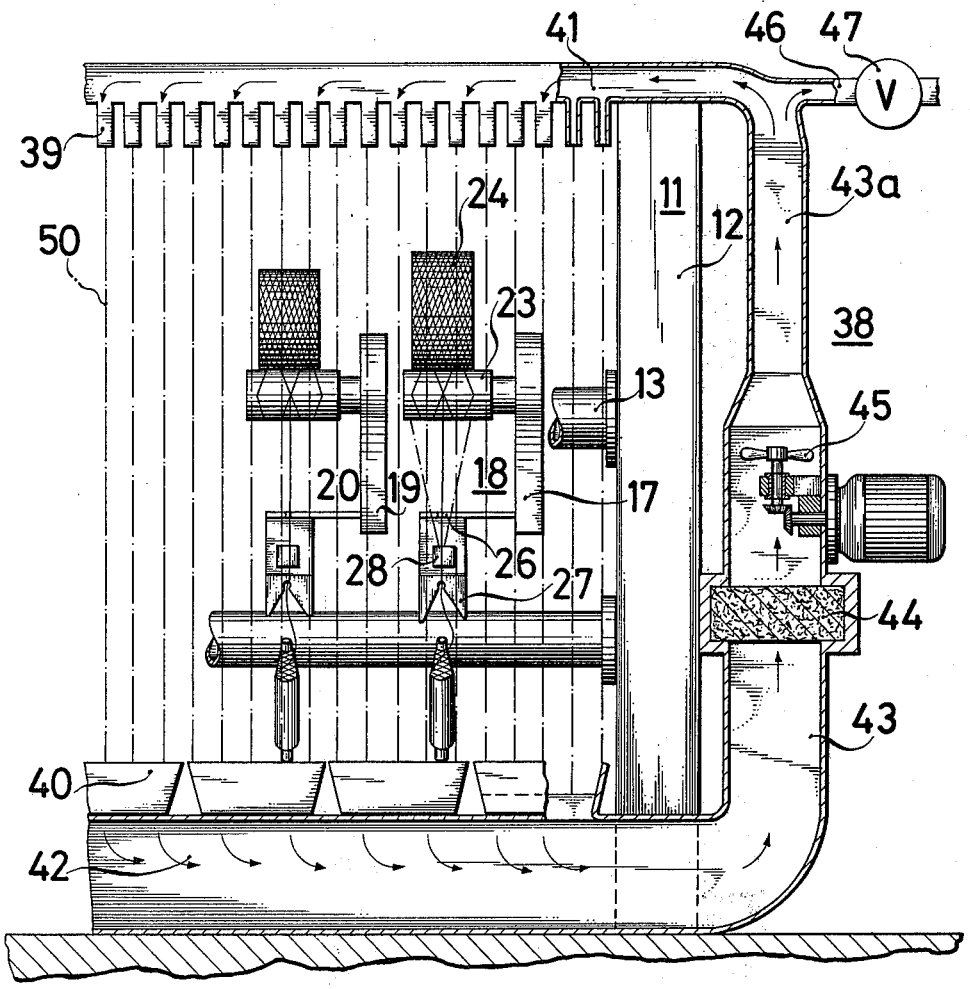
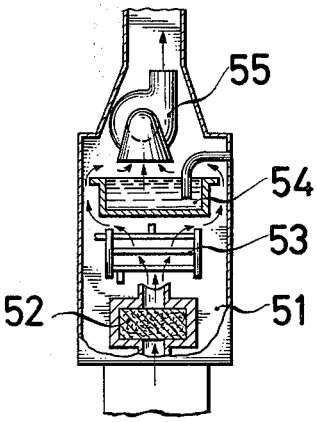
FIG. 3

DEVICE FOR PREVENTING THE DISCHARGE OF DUST AND FIBER PARTICLES FROM THE WORK ZONES OF A TEXTILE MACHINE

The invention relates to a method and device for preventing the discharge of dust and fiber particles from the work zones of textile machines, especially winding machines or spinning frames, having a region of running threads therein. The discharge is to be prevented from reaching the ambient air of a machine room in which the textile machine is installed.

It has been known heretofore to suction off dust and fiber particles from the work zones, i.e. from the region surrounding the running thread or threads. It is also known to blow off dust and deposited fiber particles which have already been deposited, and to subsequently suction them off as well. In addition, measures are also known by which air-conditioned air is brought to the running threads so that their processability and/or workability can be improved or kept constant.

Contrary to all these measures, it is accordingly an object of the invention to provide a device for preventing the discharge of dust and fiber particles from the work zones of a textile machine, which overcomes the hereinafore described disadvantages of the heretofore known devices of this general type, which discharge into the ambient air of a machine room in which the textile machine is installed. According to the invention, this problem is solved by blowing at least one closed air screen between the work zones and the ambient air.

With the foregoing and other objects in view there is provided, in accordance with the invention, an apparatus for preventing the discharge of dust and fiber particles from textile machine (especially winding machine or spinning frame) work zones having running threads disposed therein, which comprises blowing at least one closed air screen between the work zones and the ambient air in the vicinity of the machine.

In accordance with the apparatus of the invention, there is provided a device for carrying out the method of preventing the discharge of dust and fiber particles from textile machine work zones having running threads disposed therein, comprising an air screen system disposed between the work zones and the ambient air in the vicinity of the machine, the air screen system including air discharge nozzles and air suction nozzles.

In accordance with another feature of the invention, the threads run in a given direction, and air blown from the discharge nozzles is directed substantially opposite to the given direction.

In accordance with a further feature of the invention, there are provided means disposed within the air screen system, which may have suction nozzles, for venting air from the work zones.

In accordance with an added feature of the invention, air received by the venting means is combined with air received by the air screen system.

In accordance with an additional feature of the invention, the suction nozzles of the venting means are identical with the suction nozzles of the air screen system.

In accordance with yet another feature of the invention, the suction nozzles of the screen system and/or of the venting means are operable to suck a greater quantity of air than the discharge nozzles are operable to discharge.

In accordance with yet a further feature of the invention, there is provided an air conditioning system connected to the air screen system so that it can assume the functions of room and machine air conditioning. This improves the running properties of the threads and their processability or workability.

In accordance with yet an added feature of the invention, there is provided a recirculated air line connected between the suction nozzles and the discharge nozzles, and a blower and a dust filter disposed in the recirculated air line.

In accordance with still another feature of the invention, there are provided baffles for directing air in the air screen system.

In accordance with a concomitant feature of the invention, the air discharge nozzles are disposed on the operating or front side of the machine, and the invention includes at least one air baffle at the rear of the machine.

The advantages achieved with the invention are in particular that pneumatic shielding of the work zones of the textile machine from the ambient air is obtained, so that the air content of breathable dust remains very low in the control and operating area. The textile machine then need not be covered up on all sides. It remains observable and freely accessible at all times. The air screen further takes care of so much air motion in the area of the machine that separate blowing devices and possibly also suction devices for dust removal are unnecessary.

The optimum construction and direction of the blowing of the nozzles, particularly of the discharge nozzles, can be experimentally determined from case to case. Thus, it may be an advantage to direct the air screen at a glancing angle over the machine parts or parts of the thread path. The venting device will advantageously have venting nozzles at those points in which dust and splitting-off of fibers occur to a particular degree. In winding machines, for instance, these are the run-off points; the points at which a thread balloon is generated; the points at which thread-guiding means are provided; and, finally, also the thread take-up points such as the take-up bobbin and its drive.

Other features which are considered as characteristic for the invention are set forth in the appended claims.

Although the invention is illustrated and described herein as embodied in a method and device for preventing the discharge of dust and fiber particles from the work zones of a textile machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 2 is a diagrammatic front elevational view of the invention, partly broken away;

FIG. 3 is a diagrammatic front elevational view of an air conditioning system useable for the invention.

Figure 1:
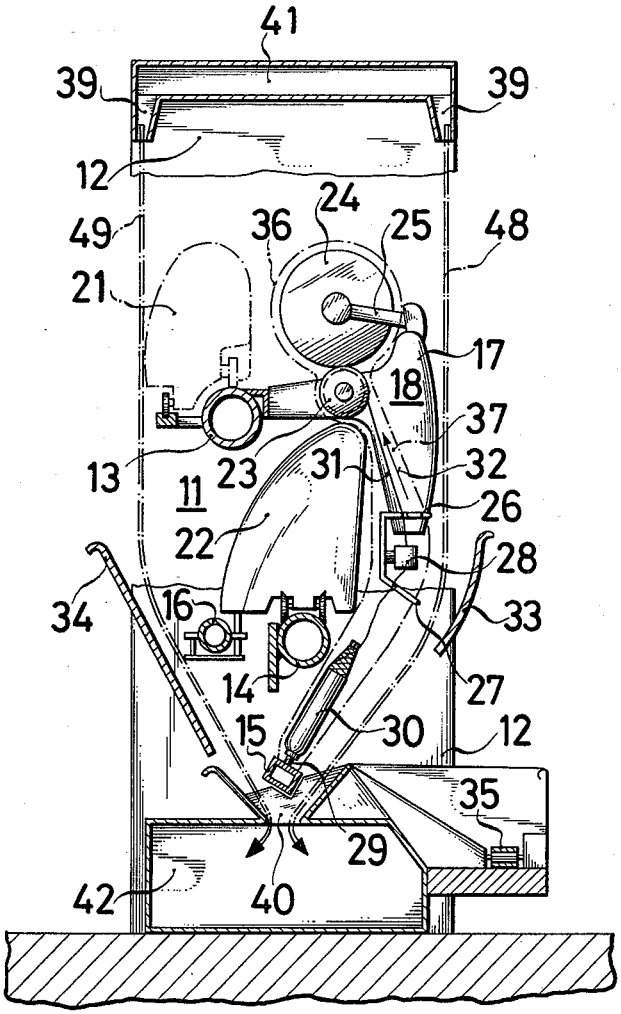
FIG. 1 is a simplified diagrammatic side elevational view of the invention.

Referring now to the figures of the drawing and first, particularly, to the first embodiment according to FIGS. 1 and 2, there is seen a winding machine given the overall designation of reference numeral 11, with a machine frame 12, to which support tubes 13, 14, 15 and a guide tube 16 are fastened. The support tube 13 carries the frames of several winding stations disposed side by side in a row. In FIG. 1, the frame 17 of the winding station 18 can be seen, and in FIG. 2, the frame 19 of the next winding station 20 can also be seen. In addition, the support tube 13 also serves as the track for a traveling operating device 21.

The support tube 14 serves as the track of a movable tieing device 22, which is braced during its travel against the support or guide tube 16. The operating device 21 and the tieing device 22 will not be discussed here in detail. Both devices have nothing to do directly with the present invention but are components of an automatic winding machine.

The frame 13 carries a winding cylinder 23, which is provided with reverse-thread grooves for guiding the thread. The take-up coil 24 which is held by a hinged coil frame 25 rolls on the winding cylinder 23. The frame 13 also carries thread baffles 26, 27 and a thread cleaner 28. The support tube 15 carries a plug 29, having a run-off bobbin or coil 30 placed thereon. During winding, the thread 31 is pulled off the run-off coil 30, is guided through openings of the thread baffle 27, the thread cleaner 28 and openings in the thread baffle 26. The thread 31 is then conducted to the winding cylinder 23, and wound up on the take-up coil 24 in cross-wound layers of thread, by means of the winding cylinder 23. The travel direction of the thread is indicated by an arrow 32. It can be seen from FIG. 1 that an air baffle 33 is disposed at the front of the machine, which is equivalent to the operating side. An air baffle 34 is furthermore disposed at the rear of the machine. In the vicinity of the floor of the machine, there is also seen a conveyor belt 35 on the operating side.

The area in which the thread 31 runs is enclosed by a dot-dash line 36, which represents the outer boundary of the work zone 37. The work zone 37 is therefore the region in close proximity to the running thread, including the runoff coil 30 and the take-up coil 24.

The work zone defined in this manner is found in any winding station of the winding machine 11. The entire winding machine therefore has as many work zones as there are winding stations with running threads.

The total number of work zones is separated by an air screen system, designated as a whole with reference numeral 38, from the ambient air of the machine room in which the winding machine 11 is installed. This air screen system 38 has identical discharge nozzles 39 and suction nozzles 40 which are likewise identical with each other. The discharge nozzles 39 extend from an air supply duct 41 located above the take-up coils 24. The suction nozzles lead into an exhaust air duct 42 located under the run-off coils 30. The flow cross section of the air supply duct 41 is smaller than the flow cross section of the exhaust air duct 42. The exhaust air duct 42 is connected to the supply air duct 41 by a circulated-air line 43, 43*a*, a dust filter 44, and an air blower 45 over which air is conducted. At the junction of the recirculated-air line 43*a* and the air supply duct 41, there is seen a line 46 leading to the outside, which has a controlled valve 47. Depending on the position of the valve 47, a larger or smaller portion of the transported air can be blown out through the line 46.

The elements 39 to 47 belong to the air screen system 38 mentioned hereinbefore. In this embodiment example, the air screen system 38 generates two air screens 48 and 49. The two air screens are closed and each extends over the entire length of the machine. FIG. 2 of the drawing indicates diagrammatically that, for instance, air screen 48 includes a multiplicity of similar flow filaments 50, which start from closely adjacent discharge nozzles 39. The form of the discharge nozzle chosen here can be modified, of course. In very simple constructions, the discharge nozzles resemble perforations of the air supply duct 41. The suction nozzles 40 are constructed in the present embodiment example in the shape of funnels, and still enclose the lower end of the work zone 37. Thus, the air screen system 38 simultaneously serves as a venting device for the work zones shielded by the air screens.

Whether the width of the opening of the valve 47 is increased or decreased, the quantity of air that can be drawn-in by the suction nozzles 40 will be greater than the quantity of air that can be delivered through the discharge nozzles 39. It is thereby insured that not only the air screen, but also the dust-containing air which may build up in the work zones, can be suctioned off completely. The air is therefore prevented from flowing off into the environment. The ambient air, on the other hand, can be taken along and suctioned off.

In the first embodiment example of the invention, the air screen system 38 can be connected alternatively to an air conditioning system 51, which is diagrammatically shown in FIG. 3. The air conditioning system 51 then takes the place of the individual units 44 and 45. In the air conditioning system 51, there is seen a dust filter 52, an air temperature control device 53, an air humidifier device 54 and an air blower 55. The air conditioning system 51 can also be a room air conditioner which simultaneously serves for air conditioning the machine room in which the textile machine is installed.

Figure 4:
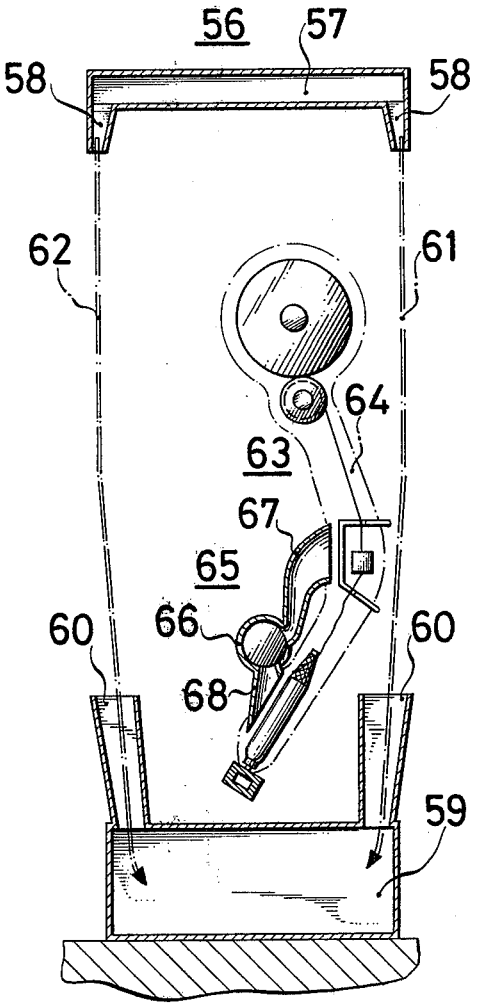
FIGS. 4 and 5 are diagrammatic side elevational views of alternative embodiments of the invention.

In the second embodiment example of the invention, according to FIG. 4, an air screen system designated as a whole with reference numeral 56, there is seen an air supply duct 57 with discharge nozzles 58 disposed in two rows, and an exhaust air duct 59, with suction nozzles 60 similarly disposed in two rows. One air screen 61 is on the front side, and the other air screen 62 is on the rear side, of the winding machine 63. In this embodiment example, the work zones 64 are vented by a venting system designated as a whole with reference numeral 65. The venting system 65 comprises a venting pipe 66, which simultaneously serves as a support tube for a non-illustrated travelling tieing device. At the points where particularly great dust development is expected, the venting nozzles 67, 68 project into the work zones 64. A non-illustrated air blower is located at the end of the venting tube 66. The air blower transports the drawn-in air to the outside through a dust filter.

Figure 5:
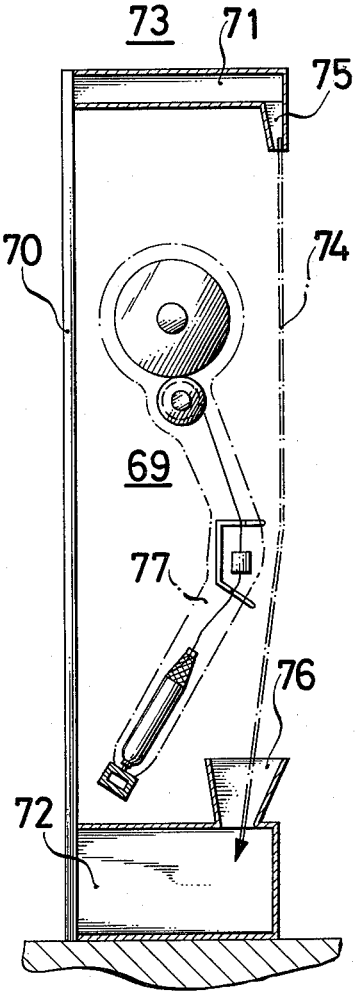

In the last embodiment example according to FIG. 5, the winding machine, designated as a whole with reference numeral 69, has a rear wall 70, which simultaneously serves as an air baffle, and also carries the air supply duct 71 and the exhaust air duct 72 of an air screen system designated as a whole with reference numeral 73. In this embodiment, a closed air screen 74 which extends over the entire length of the machine is only provided on the operating side of the machine. The air screen 74 extends from discharge nozzles 75 to suction nozzles 76. There is no separate suction from the work zone 77 in the embodiment of FIG. 5. In this embodiment example also, the air screen 75 is directed against the travel direction of the thread. This generates sufficiently large air flow eddies within the machine to carry dust which has been produced with them. This dust produced is also ultimately taken up through the suction nozzles 76.

In individual cases, provision could also be made for the flow direction of the air screens to be from the bottom up. The position of the supply air ducts and the exhaust air ducts would then have to be reversed.

The embodiment examples show that all parts of the textile machine remain freely accessible. If parts of the travelling operating devide protrude from the air screen during travel, this would probably not be very harmful. During manipulation the air screen is disturbed, but not to a very large extent, and not for a long time.

There are claimed:

1. Device for carrying out a method of preventing the discharge of dust and fiber particles from textile machine work zones having running threads disposed therein, comprising a machine frame, air supply and exhaust ducting connected to said machine frame, air discharge and air suction nozzles disposed on said ducting generating a closed air screen system separating the work zones from the ambient air in the vicinity of the machine, and additional means being connected to said ducting and being disposed within said air screen system for venting air from the work zones.

2. Device according to claim 1, wherein the threads run in a given direction, and air blown from said discharge nozzles is directed substantially opposite to said given direction.

3. Device according to claim 1, including suction nozzles integral with said venting means.

4. Device according to claim 3, wherein air received by said venting means is combined with air received by said air screen system.

5. Device according to claim 4, wherein said suction nozzle of said venting means are identical with said suction nozzles of said air screen system.

6. Device according to claim 3, wherein said suction nozzles of said air screen system are operable to suck a greater quantity of air than said discharge nozzles are operable to discharge.

7. Device according to claim 3, wherein said suction nozzles of said air screen system and said venting means are operable to suck a greater quantity of air than said discharge nozzles are operable to discharge.

8. Device according to claim 1, including an air conditioning system connected to said air screen system.

9. Device according to claim 1 or 3, including a recirculated air line connected between said suction nozzles and said discharge nozzles, and a blower and a dust filter disposed in said recirculated air line.

10. Device according to claim 1, including baffles for directing air in said air screen system.

11. Device according to claim 1, wherein said air discharge nozzles are disposed on the operating or front side of the machine, and including at least one air baffle at the rear of the machine.

* * * * *